United States Patent [19]

Caputo et al.

[11] 4,128,141

[45] Dec. 5, 1978

[54] ELEVATOR SYSTEM

[75] Inventors: William R. Caputo, Wyckoff; Alan L. Husson, Budd Lake, both of N.J.

[73] Assignee: Westinghouse Electric Corp., Pittsburgh, Pa.

[21] Appl. No.: 813,560

[22] Filed: Jul. 7, 1977

[51] Int. Cl.[2] ..... B66B 5/06

[52] U.S. Cl. ..... 187/29 R

[58] Field of Search ..... 187/29

[56] References Cited

U.S. PATENT DOCUMENTS

| | | | |
|---|---|---|---|
| 3,474,886 | 10/1969 | Iordanidis | 187/29 |
| 3,779,346 | 12/1973 | Winkler | 187/29 |
| 3,814,216 | 6/1974 | Pisatowski | 187/29 |
| 4,067,416 | 1/1978 | Lowry | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including an elevator car mounted for guided movement in a vertical travel path. A signal related to car velocity is modified by a signal related to car acceleration. The modified velocity signal is utilized in a speed monitoring system which monitors car speed as a function of car position adjacent the travel limits of the elevator car.

10 Claims, 8 Drawing Figures

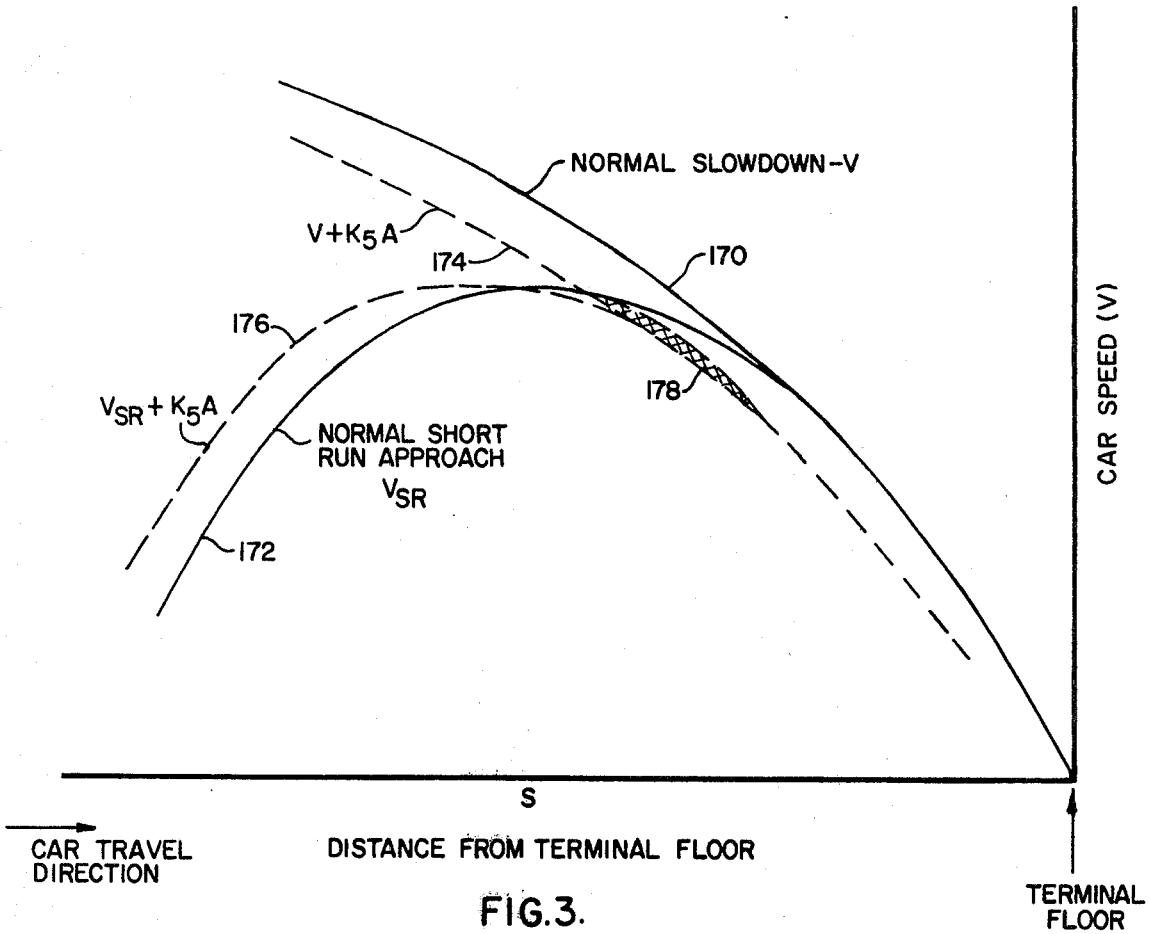
FIG.3.
FIG.5.
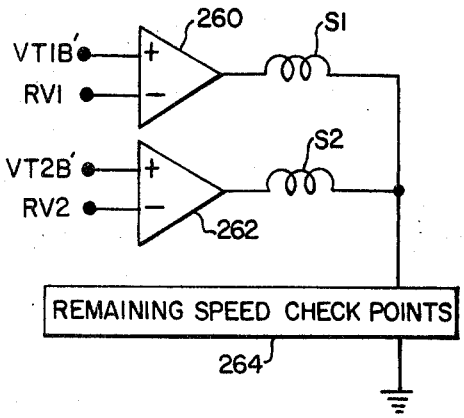
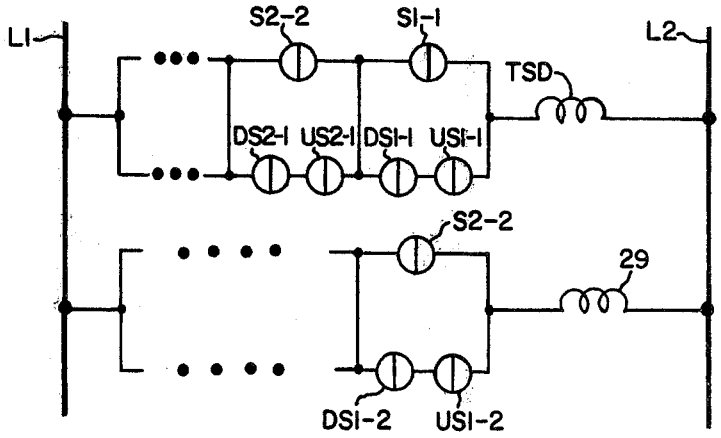
FIG.6.

ELEVATOR SYSTEM

BACKGROUND OF THE INVENTION

1. Field of the Invention

The invention relates in general to elevator systems, and more specifically, to new and improved speed monitoring apparatus for elevator systems.

2. Description of the Prior Art

Speed monitoring and limiting devices adjacent to the terminals or travel limits of an elevator car may monitor the floor selector. If the floor selector is not operating in a manner which will produce a normal slowdown, an auxiliary speed pattern is produced for controlling terminal slowdown. In a prior art arrangement for monitoring an electromechanical floor selector, a long cam is disposed adjacent each terminal. The cam opens a series of switches mounted on the elevator car, one after another, as the car approaches a terminal floor. If the floor selector is operating properly, for each cam operated "switch opening" in the hoistway, there will be a "switch closing" on the floor selector carriage. If this fails to occur, an auxiliary speed pattern is provided.

Speed monitoring and limiting devices adjacent to the terminals may monitor the speed pattern generator as the elevator can approaches a terminal. A terminal slowdown pattern is provided in place of the normal deceleration pattern when a malfunction is detected, to decelerate the car into the terminal floor. Modification of the speed pattern generator signal, however, will not cause the car to decelerate if there is a problem in the drive system. Also, the speed pattern generator may be functioning correctly, but because of a problem in the drive system, the car may not be decelerating along a desired trajectory as it approaches a terminal floor. Such a system takes no action and may allow the car to approach the terminal at an excessive speed.

A speed monitoring system which monitors car speed as a function of car position can provide a high degree of protection against approaching a terminal at an excessive speed. U.S. Pat. No. 3,779,346, which is assigned to the same assignee as the present application, discloses such a system which continuously monitors the car speed as a function of car position, as the car approaches each terminal floor. In this arrangement, closely spaced markers mounted in the hoistway adjacent each terminal cooperate with a sensor disposed on the car to provide a continuous speed error signal which is used in a reference circuit to detect overspeed. The speed error signal is also used in a circuit which generates an auxiliary slowdown pattern. The auxiliary slowdown pattern is substituted for the normal speed pattern when overspeed is detected. If the problem is not in the speed pattern circuits, but in the drive, generation of an auxiliary speed pattern will not be effective. Thus, this arrangement if used with a low inertia, fast acting car speed sensor switch as a backup, such as the speed sensor disclosed in U.S. Pat. No. 3,814,216, which is assigned to the same assignee as the present application. If the car speed is excessive at the car position relative to the terminal monitored by this speed sensing switch, the car is forced to make an emergency stop.

Application Ser. No. 628,448 filed Nov. 3, 1975, which application is assigned to the same assignee as the present application, discloses a discrete car speed monitoring system, as opposed to the continuous car speed monitoring system of U.S. Pat. No. 3,779,346. This discrete monitoring system monitors car speed as a function of car position at a plurality of discrete speed checkpoints in the hoistway. The car speed is compared with two reference speeds at most car position checkpoints. If the car speed exceeds the lower but not the upper reference speed, the system attempts to decelerate the car by employing an auxiliary terminal slowdown velocity pattern. If the car speed exceeds the upper reference speed at any checkpoint, the car is forced to make an emergency stop.

The present invention is directed to an improvement in elevator car speed monitoring systems which monitor car speed as a function of discrete car positions adjacent to a terminal floor.

SUMMARY OF THE INVENTION

Briefly, the present invention is a new and improved elevator system having a speed monitoring arrangement which monitors car speed as a function of car position at a plurality of discrete car position checkpoints in the hoistway. Instead of comparing a signal related to car speed with a reference signal at a particular car location, such as in prior art speed monitoring systems, the present invention modifies the car speed signal by a signal which is related to car acceleration. The present invention then compares the modified speed signal with a reference signal. Thus, for a given distance from the terminal for a car position switch, the reference signal may be lower in magnitude than in prior art monitoring systems; or, conversely, the position switch may be positioned farther from the terminal for a given reference speed.

The present invention takes advantage of the fact that the car should be decelerating, i.e., the acceleration should be negative, if the car is on the correct trajectory as it passes a speed checkpoint in the hoistway. The velocity signal is modified by the acceleration signal in a manner which reduces the absolute magnitude of the velocity signal if the car is decelerating as it approaches a terminal floor. If the car is traveling at constant speed, the acceleration signal will be zero and the absolute magnitude of the velocity signal will not be reduced. If the car is accelerating towards a terminal floor, the absolute magnitude of the velocity signal is increased by the acceleration signal.

Thus, the probability of detecting can overspeed condition at any particular speed checkpoint is increased, as the modified velocity signal includes an anticipation factor which takes into account how the car speed is changing. This fact, along with the fact that for a given reference speed the car position switch is set farther from a terminal floor, increases the probability of making a terminal slowdown or emergency stop without overshoot of the terminal floor. Further, these advantages are achieved with no greater degree of nuisance tripping of the speed circuits than with prior art systems which do not include an "anticipation" factor in the speed checking circuits.

BRIEF DESCRIPTION OF THE DRAWING

The invention may be better understood, and further advantages and uses thereof more readily apparent, when considered in view of the following detailed description of exemplary embodiments, taken with the accompanying drawings, in which:

FIG. 3 is a graph of car speed versus distance to a terminal floor, which illustrates a short run towards a terminal floor when the car is in a terminal speed protection zone;

FIGS. 5 and 6 are schematic diagrams illustrating control circuitry which may be used in the supervisory control circuits shown in block form in FIG. 1.

DESCRIPTION OF PREFERRED EMBODIMENTS

The present invention relates to elevator systems which monitor elevator car speed as a function of car location, at a plurality of discrete spaced car positions adjacent each travel limit or terminal floor. Since the elevator system of the hereinbefore mentioned Application Ser. No. 628,448, filed Nov. 3, 1975 is of this type, the subject matter of that application is hereby incorporated into the present application by reference. Only those parts of the incorporated application necessary to understand the present invention are repeated herein. It is to be understood, however, that the invention is equally applicable to other types of elevator systems which monitor car speed as a function of discrete car locations adjacent a terminal floor.

Figure 1:
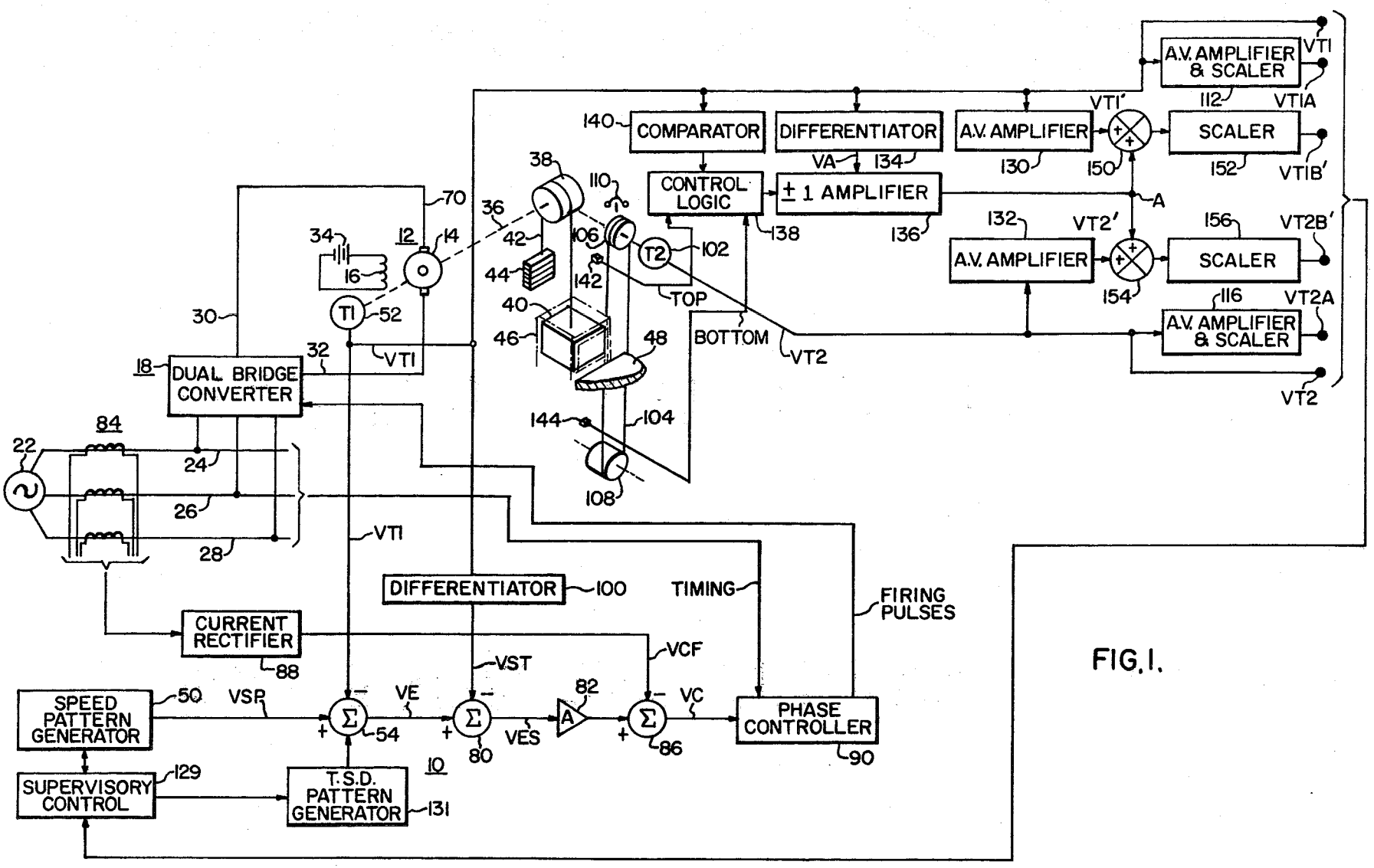
FIG. 1 is a partially schematic and partially block diagram of an elevator system constructed according to the teachings of the invention.

Referring now to the drawings, and to FIG. 1 in particular, there is shown an elevator system 10 which includes a direct current drive motor 12 having an armature 14 and a field winding 16. The armature 14 is electrically connected to an adjustable source of direct current potential. The source of potential may be a direct current generator of a motor-generator set in which the field of the generator is controlled to provide the desired magnitude of unidirectional potential; or, as shown in FIG. 1, the source of direct current potential may be a static source, such as a dual converter 18.

The dual converter 18 includes first and second converter banks which may be three-phase, full-wave bridge rectifiers connected in parallel opposition. Each converter includes a plurality of controlled rectifier devices connected to interchange electrical power between alternating and direct current circuits. The alternating current circuit includes a source 22 of alternating potential and busses 24, 26 and 28, and the direct current circuit includes busses 30 and 32, to which the armature 14 of the direct current motor 12 is connected.

The field winding 16 of drive motor 14 is connected to a source 34 of direct current voltage, represented by a battery in FIG. 1, but any suitable source, such as a single bridge converter, may be used.

The drive motor 12 includes a drive shaft indicated generally by broken line 36, to which a traction sheave 38 is secured. An elevator car 40 is supported by a rope 42 which is reeved over the traction sheave 38, with the other end of the rope being connected to a counterweight 44. The elevator car is mounted for guided vertical movement in a hoistway 46 of a structure or building having a plurality of floors or landings, such as floor 48, which are served by the elevator car.

The movement mode of the elevator car 40 and its position in its vertical travel path are controlled by the voltage magnitude applied to the armature 14 of the drive motor 12. The magnitude of the direct current voltage applied to armature 14 is responsive to a velocity command signal VSP provided by a suitable speed pattern generator 50. The servo control loop for controlling the speed, and thus the position of car 40 in response to the velocity command signal VSP may be of any suitable arrangement, with a typical control loop being shown schematically in FIG. 1.

A signal VT1 responsive to the actual speed of the elevator drive motor 12 is provided by a first tachometer 52. A comparator 54 provides an error signal VE responsive to any difference between the velocity command signal VSP and the actual speed of the motor 12, represented by signal VT1.

Tachometer 52 is coupled to the shaft 36 of the drive motor 12 via a rim drive arrangement, i.e., the tachometer 52 has a roller secured to its drive shaft which contacts and is frictionally driven by the circumferential surface of the motor drive shaft, or a suitable member such as sheave 38 which rotates with the motor drive shaft 36 of the drive motor 12. Since the tachometer 52 is coupled to the drive motor with a rim drive arrangement, a tachometer having a relatively low ripple such as 2% peak-to-peak, may be used, as its high quality output signal will not be degraded by electrical noise such as would be generated by a belt drive arrangement. A disadvantage of the rim drive is possible slippage, but the incorporated application discloses self-checking circuits which will detect such slippage, as well as other tachometer failure.

Since a tachometer having a relatively low ripple may be used, which tachometer when rim driven has a minimum of electrical noise in its output signal, a superior stabilizing signal for achieving smooth system response may be obtained by taking the derivative of the tachometer output signal VT1. Accordingly, a differentiation circuit 100 is provided for differentiating signal VT1 and providing a stabilizing signal VST. The stabilizing voltage VST is applied as a negative feedback signal to the closed control loop, stabilizing the signal VE. Signals VE and VST are applied to a summing circuit 80 with the algebraic signs illustrated in FIG. 1, in order to provide a stabilized error signal VES. The stabilized error signal VES may be amplified in an amplifier 82, and depending upon the specific control loop utilized, the amplified signal may be compared with a signal VCF in a comparator 86, with signal VCF being responsive to the current supplied to the dual converter 18. Signal VCF may be provided by any suitable feedback means, such as by a current transformer arrangement 84 disposed to provide a signal responsive to the magnitude of the alternating current supplied by the source 22 to the converter 18 via busses 24, 26 and 28, and a current rectifier 88 which converts the output of the current transformer arrangement 84 to a direct current signal VCF. As disclosed in U.S. Pat. No. 3,713,012, which is assigned to the same assignee as the present application, amplifier 82 may be a switching amplifier which is responsive to the polarity of the input signal to enable the unidirectional signal VCF to be used regardless of the polarity of the input signal VES.

Signal VCF and the amplified signal VES are compared in a comparator 86 to provide a signal VC responsive to any difference, which signal is applied to a phase controller 90. Phase controller 90, in response to timing signals from busses 24, 26 and 28 and the signal VC, provides phase controlled firing pulses for the controlled rectifier devices of the operational converter bank. The hereinbefore mentioned U.S. Pat. No. 3,713,012 discloses a phase controller which may be used for the phase controller 90 shown in FIG. 1.

According to the teachings of the incorporated application, a second tachometer 102 is provided which is responsive to the speed of the elevator car 40. The second tachometer 102 provides a check on the rim driven tachometer 52. It may be less costly tachometer than tachometer 52, i.e., it may have a higher ripple compared with that of tachometer 52, since its output will not be differentiated to provide a stabilizing signal. The second tachometer 102 may be driven from the governor assembly which includes a governor rope 104 connected to the elevator car 40, reeved over a governor sheave 106 at the top of the hoistway 46, and reeved over a pulley 108 located at the bottom of the hoistway. A governor 110 is driven by the shaft of the governor sheave, and the tachometer 102 may also be driven by the shaft of the governor sheave 106, such as via a belt drive arrangement. The belt drive is fail-safe with broken belt switches, and since the signal from tachometer 102 will not be differentiated, the electrical noise added to the signal by the belt drive is not of critical importance.

The velocity signal VT1 provided by tachometer 52, which signal is responsive to the speed of the elevator drive motor 12, is processed and scaled in an absolute value amplifier 112. The output of amplifier and scaler 112 is a unipolarity signal VT1A proportional to the magnitude of the velocity signal VT1, with the scaling of 10 volts per 450 feet per minute. In like manner, the velocity signal VT2 provided by tachometer 102, which signal is responsive to the speed of the elevator car 40, is processed and scaled in an absolute value amplifier 116. The output of amplifier and scaler 116 is a unipolarity signal VT2A, proportional to the magnitude of the velocity signal VT2, with a scaling of 10 volts per 450 feet per minute. The scaled signals VT1A and VT2A are used to develop control signals which indicate whether the elevator car is traveling below or above specific speeds. For example, 30 fpm and 150 fpm speed checkpoints used during slowdown and leveling at each floor may be generated from signals VT1A and VT2A, respectively.

Signals VT1 and VT2 are further processed according to the teachings of the invention, to provide signals VT1B' and VT2B', respectively. These speed signals are utilized in monitoring car speed adjacent the travel limits of the elevator car 40, i.e., adjacent the terminal floors. Apparatus for processing speed signals VT1 and VT2 includes absolute value amplifiers 130 and 132, respectively, which provide signals VT1' and VT2' which correspond to the absolute magnitude of the values of signals VT1 and VT2. Signals VT1 and VT2 are negative when the elevator car is running up, and positive when the elevator car is running down. Amplifiers 130 and 132, in effect, provide positive signals regardless of the polarity of signals VT1 and VT2.

Signal VT1 is also processed in a differentiation circuit 134 to provide a signal VA related to the rate of change of car velocity, i.e., acceleration. Signal VA is applied to a $\pm 1$ amplifier 136 which provides a signal A having a polarity determined by control logic 138. Control logic 138, for reasons which will be hereinafter explained, is responsive to the car travel direction via a comparator 140 which is responsive to the polarity of signal VT1, and to the location of the elevator car 40 in the hoistway 46. A detector 142 in the hoistway 46 provides a true or logic one signal TOP for control logic 138 when the elevator car is located in the terminal slowdown protection zone adjacent to the top terminal floor. A detector 144 in the hoistway 46 provides a true or logic one signal BOT for control logic 138 when the elevator car is located in the terminal slowdown protection zone adjacent to the bottom terminal floor. The lengths of these terminal slowdown protection zones depend upon rated car speed, and the maximum rate of deceleration to be applied to the elevator car during auxiliary terminal slowdown, and during an emergency stop.

Signal VT1' is modified by signal A in a summing circuit 150, and the resulting signal is scaled in a scaler 152, such as 10 volts per 1800 feet per minute. The output of the scaler is the hereinbefore referred to signal VT1B'.

Signal VT2' is modified by signal A in a summing circuit 154, and the resulting signal is scaled in a scaler 156, such as 10 volts per 1800 feet per minute. The output of scaler 156 provides the hereinbefore mentioned signal VT2B'.

Summing circuits 150 and 154 each include summing resistors, the values of which are selected to select the percentage of signal A which will modify the associated velocity signal. The selected percent will be referred to as a constant $K_5$, and thus the actual magnitude by which the velocity signal is modified is equal to $K_5A$.

Supervisory control 129 is provided, specific circuits thereof which will be hereinafter described in detail, for processing the signals VT1, VT1A, VT1B', VT2, VT2A and VT2B', to provide indications that certain speed checkpoints have been exceeded, to compare the signals in a manner which provides a check on the performance of the elevator system, to activate a terminal slowdown pattern generator 131 when the normal slowdown speed for a terminal floor is exceeded, and to otherwise modify the operation of the elevator system 10 when the supervisory or monitoring circuits of control 129 indicate the system is not operating properly.

Summarizing to this point, instead of comparing the car speed directly with the reference speeds, as in prior art systems, a signal $K_5A$ proportional to car acceleration is added to a signal proportional to car speed for comparison with the reference speeds. This arrangement permits the reference speeds to be set at a lower magnitude for a given distance from a terminal floor, or each position switch may be positioned farther from the terminal for a given reference speed. Advantage is taken of the fact that the car is decelerating if it is on the correct trajectory, within its normal tolerance limits, as it passes a checkpoint. If a car passes a checkpoint and is not decelerating, or it is accelerating, the speed which the monitoring circuits "see" would be greater than if the car were decelerating, and the probability of a malfunction being detected earlier is significantly increased. The probability of nuisance tripping is not increased. Since, for a given reference speed, the position switch is located farther from the terminal floor, the car can make a terminal slowdown or emergency stop with a greater probability of not overshooting the terminal floor.

In order for the concept of modifying the velocity signal with a signal $K_5A$ proportional to car acceleration to apply universally to all elevator systems, the control must be able to accommodate normal acceleration of the elevator car towards the terminal, within the travel limit protection region or zone, for so-called "short runs" of the elevator car. For example, in an elevator system with a rated or contract speed of 1800 fpm, and with a maximum deceleration of 4 ft/sec.$^2$, the protected zones may extend 80 feet from each terminal floor. If a car is making a run of about 12 or less floors towards a terminal floor while in this region, it will accelerate toward the terminal for about the first half of the run. As the car approaches its maximum speed for the particular run, it will still be accelerating, the signal A will increase the absolute magnitude of the velocity signal, and to the speed monitors the speed will thus appear to be higher than the actual speed of the car. If a monitor happens to be positioned at the precise position of apparent maximum velocity, and the car speed is at its upper allowable limit, and the speed switch is at its lowest allowable limit, and the position switch is at its greatest allowable distance from the terminal, a nuisance trip of the speed monitoring circuits would occur.

We have found that normal acceleration towards a terminal floor in the protected terminal zone may be accommodated without nuisance tripping of the speed monitoring circuits, by reducing the absolute magnitude of the acceleration signal $K_5A$ by a signal $(K_5^2J/2)$. J is the rate of change of car acceleration, i.e, jerk. This signal may be obtained by differentiating the acceleration signal VA and summing the signal with the velocity signal and $K_5A$. However, since differentiating the acceleration signal may provide a signal having objectionable electrical noise, the benefit of the $K_5A$ signal may be reduced by the value $(K_5^2J/2)$ in the placement of the speed checkpoints adjacent to each terminal.

A second normal situation which must be accommodated by the speed monitoring circuits is the fact that as the elevator car leaves a terminal floor it will be accelerating. Therefore, the apparent speed to the speed monitors appears to be higher than the actual car speed, possibly resulting in a nuisance tripping of the speed monitoring circuits. This may be avoided by using directional speed switches and two sets of speed points for each terminal. However, since this would necessitate additional hardware and wiring, it would be desirable not to segregate the positions according to car travel direction.

We have eliminated the need for segregating speed check positions adjacent each terminal according to car travel direction by using absolute value speed points. The absolute value of the velocity is reduced by the term $K_5A$ when the car is decelerating towards a terminal floor, and the absolute value of the velocity is also reduced by the term $K_5A$ when the car is accelerating away from a terminal floor. The logic control for performing these functions will be hereinafter explained.

Figure 2:
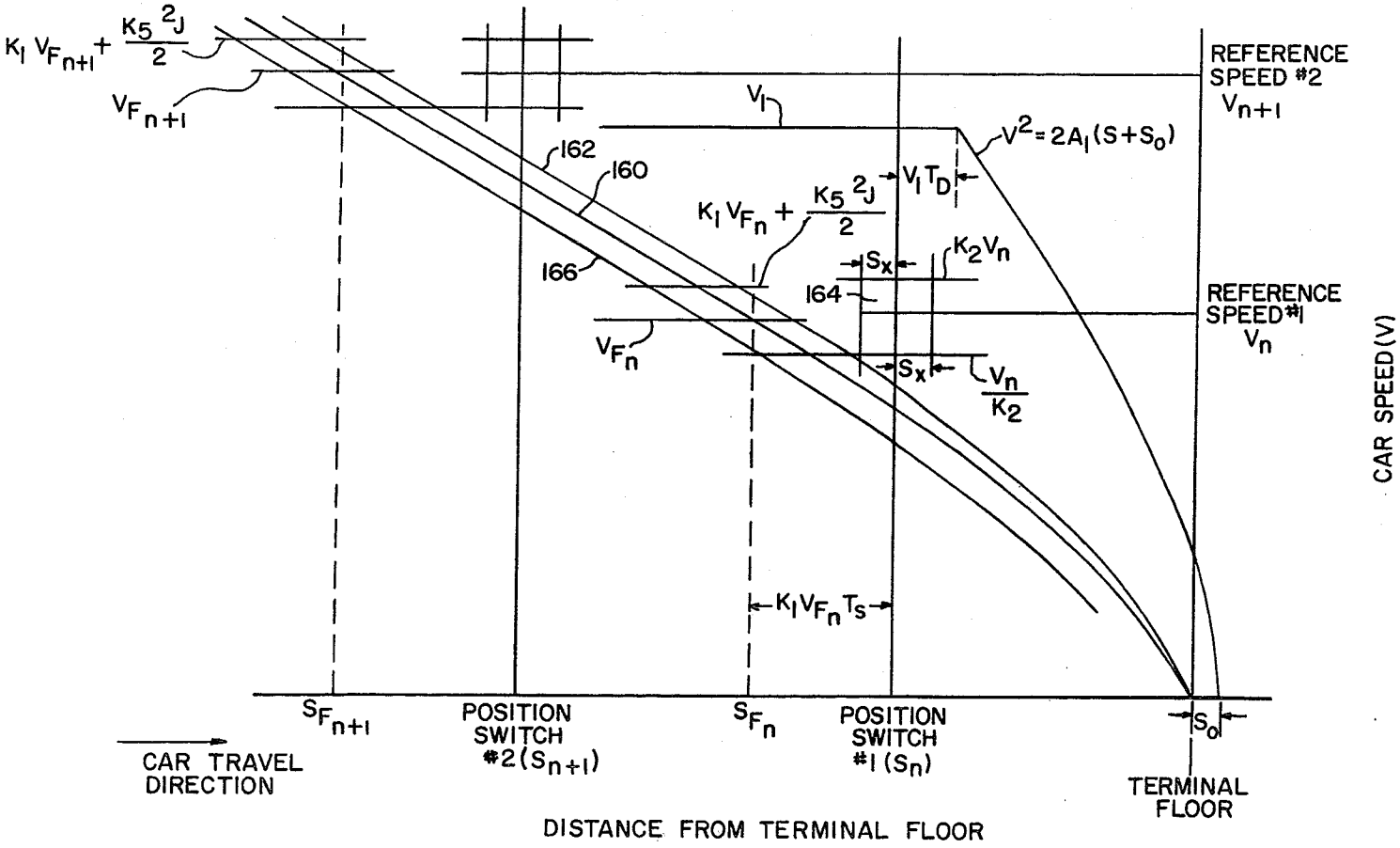
FIG. 2 is a graph of car speed versus distance to a terminal floor, which illustrates the benefits of the invention.

FIG. 2 is a graph which will aid in understanding the invention. The graph of FIG. 2 plots car speed on the ordinate versus car position adjacent a terminal floor on the abscissa. Two adjacent speed checkpoints are illustrated in FIG. 2, but a larger numbered plurality will be utilized in the average elevator system. For each car position switch there is a speed monitor which includes a reference value for comparison with the car speed signal. The normal tolerances in the positioning of the car position switches, and the normal tolerances in the tripping of the car speed sensor switches are also illustrated.

Curve 160 in FIG. 2 illustrates the normal car trajectory. Curve 162 illustrates the allowable normal maximum velocity trajectory, which curve includes the bias $K_5^2J/2$ which was developed to accommodate short runs towards a terminal floor in the protected zone. It will be noted how close curve 162 is to the area 164 which represents the tripping range of the first speed monitor. With a tolerance stackup which initiates tripping at the lower lefthand corner of the tripping rectangle, nuisance tripping could occur on a short run towards a terminal floor in the protected zone.

Curve 166 illustrates the maximum velocity curve 162 reduced according to the invention by the factor $K_5A$. Curve 166 is the velocity signal output from the summing circuits 150 and 154.

In implementing the teachings of the invention, the following design philosophies are observed:

(1) For a car approaching the terminal at its normal maximum allowable velocity, there should be no tripping of any speed monitor for any extreme case of speed setting, position setting, or device response as long as they are within their design limits.

(2) For a car passing a speed checkpoint just below its trip value for any setting of the devices within their design limits, a car overspeed condition will be detected at the next checkpoint, assuming constant velocity, in time to decelerate on terminal slowdown at the maximum desired deceleration rate without overshooting of the terminal floor.

In order to meet the first design criterion, the highest allowable speed plus acceleration signal is set equal to the lowest possible trip speed of the speed monitor. If $A_2$ is the maximum normal deceleration rate, $K_1V_{F_n}$ is the maximum car speed, and $V_n \div K_2$ is the tolerance of the speed monitor relay, then curve 166 in FIG. 2 may be represented by:

$$K_1V_{F_n} - K_5A_2 + \frac{K_5^2J}{2} = \frac{V_n}{K_2} \tag{1}$$

The relationship of expression (1) allows a car speed on the normal trajectory to be determined for a given nominal speed monitor trip point and worst case approach conditions:

$$V_{F_n} = \frac{\frac{V_n}{K_2} + K_5A_2 - \frac{K_5^2J}{2}}{K_1} \tag{2}$$

From the car speed on the normal trajectory, the distance $S_{F_n}$ of the car from the terminal when the speed monitor threshold must be passed may be determined by:

$$S_{F_n} = \frac{V_{F_n}^2}{2A_2} \tag{3}$$

The nominal distance $S_n$ at which the position switch should be set to prevent nuisance trips is the actual car position $S_{F_n}$ at which the speed monitor threshold must be passed minus the distance the car travels during the speed monitor response time $T_s$, minus the tolerance $S_x$ of the position switch:

$$(4)\ S_n = S_{F_n} - K_1V_{F_n}T_s - S_x$$

In order to meet the second requirement of the basic design philosophy, the next higher speed monitor point $V_{n+1}$ must be chosen based on the closest the car could be to the terminal before the overspeed condition is detected, constrained by the response time $T_D$ of the terminal slowdown circuits, the allowable overshoot $S_o$ of the terminal floor, and the maximum desired deceleration rate $A_1$. Using these constraints, the maximum car velocity allowed at the checkpoint is:

$$(5)\quad V_1 = A_1T_D + \sqrt{A_1^2T_D^2 + 2A_1(S_n+S_o-S_x)}$$

For a worst case solution the upper limit of the next higher speed monitoring point should be set equal to the maximum allowed car velocity given above. It is not likely that all of the factors involved would ever be such as to cause the worst case condition to occur. Therefore, a spreading factor $K_3$ is introduced and the next higher speed monitoring point is given by the expression:

$$V_{n+1} = \left(\frac{V_1}{K_2}\right) K_3 \qquad (6)$$

The larger the spreading factor $K_3$ becomes, the greater the chance of exceeding the desired maximum deceleration rate, and also the greater the chance of overshooting the terminal floor.

A computer program was written to utilize the equations developed above, in order to determine a set of car position checkpoints to meet the design philosophies hereinbefore set forth. A set of speed checkpoints was developed without the $K_5A_2$ modification taught by the invention, and a set of speed checkpoints was developed with the acceleration modification of the velocity signal according to the teachings of the invention.

The following values were assumed for both computer runs:

$A_1 = 7$ ft./sec.$^2$ $A_2 = 4$ ft./sec.$^2$ $K_1 = 1.05$ $K_2 = 1.025$ $K_3 = 1$ $S_o = 0$ $S_x = 0.125$ foot $T_s = 2.5 \times 10^{-2}$ sec.

$T_D = 5 \times 10^{-2}$ sec.

For the first run, the $K_5A_2$ modification was eliminated by setting $K_5 = 0$. For the second run, $K_5$ was set equal to 0.3. Table I is a listing of the speed checkpoints without the $K_5A_2$ modification, and Table II is a listing of the speed checkpoints with the $K_5A_2$ modification.

TABLE I

| Speed (FPM) | Position (Feet) |
|---|---|
| 349.9998 | 3.40483 |
| 376.6992 | 3.97559 |
| 409.7886 | 4.74227 |
| 450.5922 | 5.77805 |
| 500.6688 | 7.18565 |
| 561.8598 | 9.10976 |
| 636.342 | 11.7547 |

TABLE I-continued

| Speed (FPM) | Position (Feet) |
|---|---|
| 726.714 | 15.4102 |
| 836.052 | 20.4878 |
| 968.07 | 27.5741 |
| 1127.196 | 37.5039 |
| 1318.74 | 51.4701 |
| 1549.068 | 71.1769 |

TABLE II

| Speed (FPM) | Position (Feet) |
|---|---|
| 349.9998 | 4.54784 |
| 440.5866 | 6.93839 |
| 551.5848 | 10.5382 |
| 686.586 | 15.912 |
| 849.99 | 23.8783 |
| 1047.168 | 35.6226 |
| 1284.606 | 52.8578 |
| 1570.128 | 78.0592 |

It will be observed from Tables I and II that the number of speed checkpoints is reduced from 13 to 8. This significant reduction in speed checkpoints is achieved, according to the teachings of the invention, with no decrease in the degree of terminal approach protection, and no increase in the probability of a nuisance trip of the speed monitoring circuits.

As previously mentioned, two factors must be taken into consideration when the acceleration term $K_5A$ is added to the velocity signal. FIG. 3 is a graph which plots car speed versus distance of the car from a terminal floor, with curve 170 illustrating an elevator car slowing down from a long run, which is the normal slowdown curve. Curve 172 illustrates an elevator car making a short run to the terminal floor. The car making the short run accelerates while it is in the terminal approach protection region and it then decelerates into the terminal floor. For each slowdown curve, a "$V+K_5A$" curve is shown with a broken line, with curve 174 illustrating $V+K_5A$ for curve 170, and curve 176 illustrating $V_{SR}+K_5A$ for curve 172. If the checkpoints were to be set on curve 174, it is possible that a car making a short run into the terminal floor could be on its normal trajectory and still trip the speed monitoring switch if a checkpoint happens to fall in the cross-hatched area 178 where curve 176 exceeds curve 174. To prevent nuisance trips, curve 174 is raised by an amount equal to the maximum value of curve 176 minus curve 174 for a given jerk J and value of $K_5$. To get an exact solution for this maximum value, the two "$V+K_5A$" values must be compared analytically versus distance from the terminal. This solution is rather difficult because of the velocity versus distance relationship of the short run curve. We found that for the values of $K_5$ of interest, the maximum value of the difference between curve 176 and 174 always occurred between the peak velocity point of the short run curve and the point where the two curves come together. In this region, the two curves may be compared with time as the independent parameter with only very small errors introduced. With time as the independent parameter, the hereinbefore referred to analytical expression $(K_5^2J/2)$ was derived for the maximum difference between curves 176 and 174. To prevent nuisance trips, the benefit of the $K_5A$ term is reduced by $(K_5^2J/2)$.

The second factor to be considered is when the car accelerates away from a terminal floor in the terminal protection zone. If no corrective action is taken during this condition, the $K_5A$ term would add to the velocity signal as the car leaves a terminal and it may cause a speed monitor to trip the speed relay. To solve this problem, the control shown in FIG. 1 is arranged such that the $K_5A$ term is based on the true acceleration of the car, and is either added to or subtracted from the absolute value of the velocity, depending upon the position of the car in the hoistway and the direction of car travel. Generally, when the car is in a terminal protection zone, its true acceleration will be in the direction away from the terminal floor. The exception to this is when the car is making a short run towards a terminal floor, and this problem is taken care of by the $(K_5^2J/2)$ term previously described. The control logic which decides whether to add or subtract the $K_5A$ term is based upon the following general rule. If the car is in a terminal protection zone and the true acceleration is away from the terminal, the control logic will be such that the absolute velocity signal is reduced. If the acceleration is into the terminal, the absolute velocity signal will be increased by the $K_5A$ term. If the car is in neither terminal zone, the control will be based upon the terminal towards which the car is headed. Thus, the control function only changes when the car stops and changes direction, or when the car leaves a terminal zone, but never when the car enters a terminal protection zone. If the control function were to be changed as the car enters a terminal protection zone, the speed switch could misoperate. Table III shows the operation of the control logic for all combinations of car position and travel direction.

TABLE III

| Car Location | Travel Direction | Effect of $K_5A$ on Absolute Magnitude Of Velocity Signal |
|---|---|---|
| Top Terminal Zone | UP | − For Decreasing A<br>+ For Increasing A |
| Middle Zone | UP | − For Decreasing A<br>+ For Increasing A |
| Bottom Terminal Zone | UP | + For Decreasing A<br>− For Increasing A |
| Top Terminal Zone | DOWN | + For Decreasing A<br>− For Increasing A |
| Middle Zone | DOWN | − For Decreasing A<br>+ For Increasing A |
| Bottom Terminal Zone | DOWN | − For Decreasing A<br>+ For Increasing A |

Figure 4:
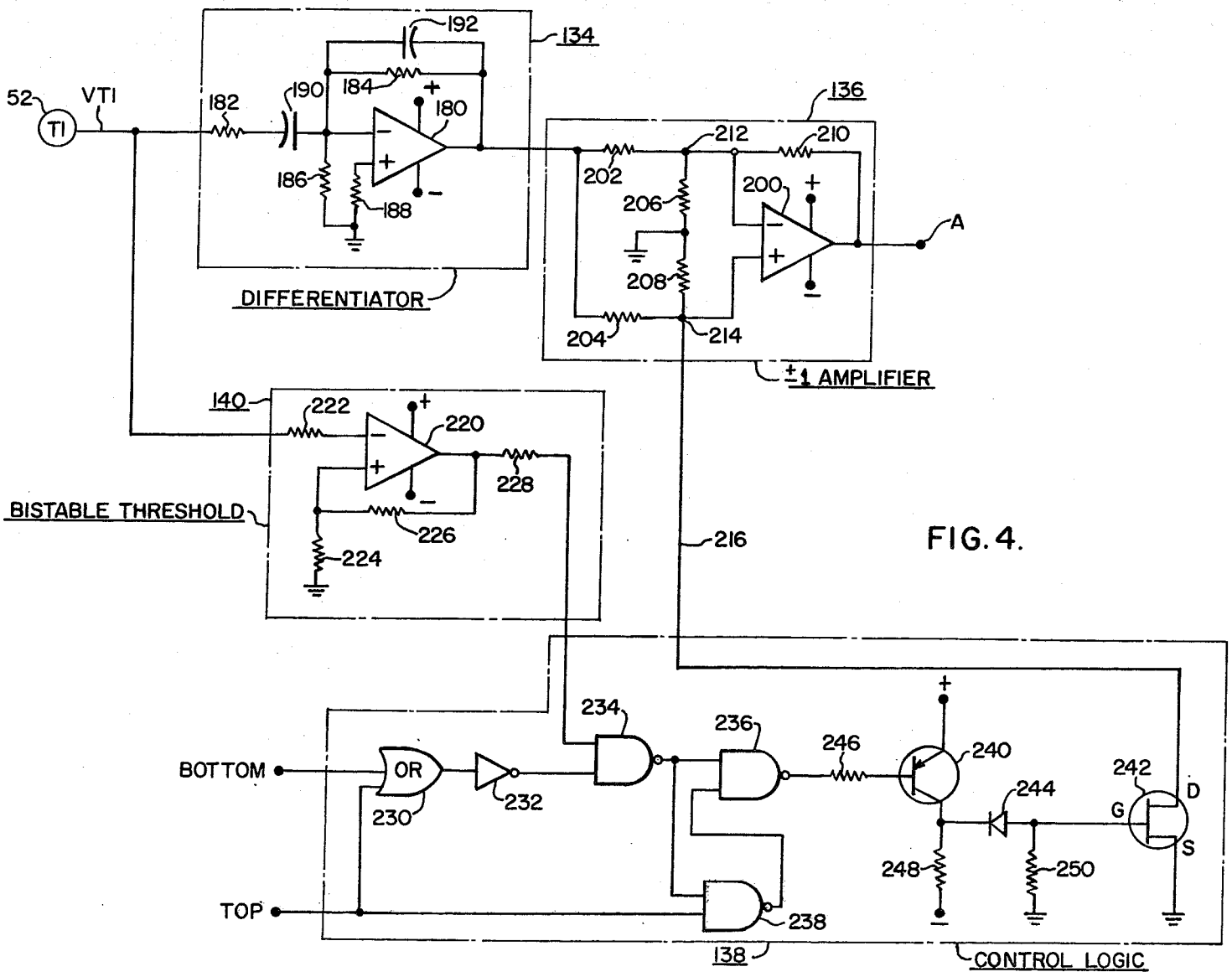
FIG. 4 is a schematic diagram which illustrates control circuitry which may be used to perform certain of the functions shown in block form in FIG. 1.

FIG. 4 is a schematic diagram which illustrates control functions which may be used for certain of the functions illustrated in block form in FIG. 1. Specifically, FIG. 4 illustrates a differentiating circuit 134, a ±1 amplifier 136, control logic 138, and a bistable threshold circuit 140, which may be used for the functions having the same reference numerals in FIG. 1.

The differentiating circuit 134 includes an operational amplifier 180, resistors 182, 184, 186 and 188, and capacitors 190 and 192. The output VT1 of the rim driven tachometer 52 is applied to the inverting input of OP amp 180 via resistor 182 and capacitor 190. Signal VT1 has a negative polarity when the elevator car is traveling up, and a positive polarity when the elevator car is traveling down. Resistors 186 and 188 are connected from the inverting and non-inverting inputs, respectively, of OP amp 180, to ground. Resistor 184 and capacitor 192 are each connected from the output of OP amp 180 to its inverting input. Resistor 182 and capacitor 192 provide high frequency noise suppression.

In the operation of the differentiating circuit 134, when the elevator car 40 starts from rest in the up travel direction, OP amp 180 will output a positive signal having a constant magnitude during the constant acceleration portion of the speed pattern. When the constant speed portion of the speed pattern is reached, the output of OP amp 180 will drop to zero. The output of OP amp 180 will output a negative signal of constant magnitude during the constant deceleration portion of the speed pattern signal.

When the elevator car starts from rest in the down direction, a negative signal of constant magnitude will be provided by OP amp 180 when the car is accelerating, the signal will drop to zero when the constant velocity portion of the speed pattern is experienced, and a positive signal of constant magnitude will be provided during the deceleration phase of the speed pattern.

The output signal of OP amp 180 is proportional to the acceleration of car 40, and this output signal is applied to the ±1 amplifier 136 which provides the acceleration signal A. The polarity of the acceleration signal A is determined by comparator 140 and control logic 138. Amplifier 136 includes an operational amplifier 200 and resistors 202, 204, 206, 208 and 210. When conductor 216 is connected to a high impedance, amplifier 136 maintains the polarity of the input signal provided by OP amp 180. On the other hand, when conductor 216 is connected to ground by control logic 138, the polarity of the signal provided by OP amp 180 is inverted. When the output of OP amp 180 is positive, junction 212 will be more positive than the grounded junction 214 and OP amp 200 will output an acceleration signal A having a negative polarity. When the output of OP amp 180 is negative, junction 212 will be more negative than the grounded junction 214, and OP amp 200 will output an acceleration signal A having a positive polarity.

Bistable threshold circuit 140 includes an operational amplifier 220 and resistors 222, 224, 226 and 228. The velocity signal VT1 is applied to the inverting input of OP amp 200 via resistor 222. The non-inverting input is connected to ground via resistor 224. Resistor 226 is a feedback resistor connected from the output of OP amp 220 to its non-inverting input, and the output of OP amp 220 is applied to the control logic circuit 138 via resistor 228. When the elevator car 40 is going up, signal VT1 has a negative polarity and the output of OP amp 220 has a positive polarity, i.e., a logic one signal for the control logic circuit 138. When the elevator car 40 is traveling in the downward direction, signal VT1 has a positive polarity and the output of OP amp 220 has a negative polarity, i.e., a logic zero for the control circuit 138.

Control logic 138 includes an OR gate 230, an inverter or NOT gate 232, dual input NAND gates 234, 236 and 238, a PNP transistor 240, a junction field effect transistor or JFET 242, a diode 244, and resistors 246, 248 and 250. OR gate 230 has its two inputs connected to switches 142 and 144 shown in FIG. 1 which provide the signals TOP and BOT, respectively. As hereinbefore stated, signals TOP and BOT will both be at the logic zero level when the car is between them, i.e., in the middle zone. Signal BOT will be at the logic one level only when car 40 is in the bottom terminal protection zone. Signal TOP will be at the logic one level only when car 40 is in the top terminal protection zone.

The output of OR gate 230 is connected to an input of NAND gate 234 via the inverter 232. The other input of NAND gate 234 is connected to receive the signal from comparator 140.

Signal TOP is also connected to an input of NAND gate 238. The output of NAND gate 234 is connected to the other input of NAND gate 238. The output of NAND gate 234 is also connected to an input of NAND gate 236. The output of NAND gate 238 is connected to the remaining input of NAND gate 236. The output of NAND gate 236 is connected to the base of PNP transistor 240 via resistor 246. The emitter of transistor 240 is connected to a source of positive potential, and its collector is connected to a source of negative potential via resistor 248.

The JFET 242 has its gate connected to ground via resistor 250, and its gate is also connected to the collector of PNP transistor 240 via diode 244. Diode 244 is poled to conduct current from the gate of JFET 242 towards the collector of transistor 240.

In the operation of the control logic circuit 138, it will first be assumed that the elevator car is traveling in the upward direction. Comparator 140 thus applies a logic one to one of the inputs of NAND gate 234. If the car is in either terminal protection zone, the output of NOT gate 232 will be low, and the output of NAND gate 234 will be high. It will first be assumed that the car is traveling upwardly in the top terminal protection zone. NAND gate 238 will have a logic one at both inputs and thus the logic zero output of NAND gate 238 forces the output of NAND gate 236 high. Transistor 240 is thus non-conductive and the gate of JFET 242 will be more negative than its source, making JFET 242 non-conductive. Conductor 216 will thus present a high impedance to amplifier 136, and amplifier 136 will be in its non-inverting mode. Thus, the positive acceleration signal A for a positive acceleration will be added to the absolute magnitude of the velocity signal. Also, an acceleration signal A having a negative polarity indicating a negative acceleration (deceleration) will be subtracted from the absolute magnitude of the velocity signal.

If the elevator car is traveling upwardly in the middle zone, NAND gate 234 will output a logic zero and the output of NAND gate 236 will be high, similar to when the car is traveling upwardly in the top terminal protection zone. Thus, amplifier 136 will be in its non-inverting mode, and no change is required as the car runs into the top terminal protection zone.

If the elevator car is traveling upwardly in the bottom terminal protection zone, NAND gates 234 and 238 will each apply a logic one to the inputs of NAND gate 236, and the output of NAND gate 236 will be low, turning transistor 240 on. The gate G of JFET 242 will be positive with respect to its source, and thus JFET 242 will turn on to connect junction 214 of amplifier 136 to ground. This forces amplifier 136 into its inverting mode. Thus, the positive acceleration signal as the car accelerates from the bottom terminal is converted to a signal A having a negative polarity which is subtracted from the absolute magnitude of the velocity signal.

Now, a down running elevator car will be considered. If the elevator car is running down in the bottom terminal zone, NAND gates 234 and 238 will each apply a logic one to the inputs of NAND gate 236, and transistor 240 and JFET 242 will each be conductive, forcing amplifier 136 into its inverting mode. Thus, the positive deceleration signal of a car decelerating into the bottom terminal will be changed by amplifier 136 to an acceleration signal A having a negative polarity which will reduce the magnitude of the absolute velocity signal. A down running car in the bottom terminal zone which is accelerating will provide an acceleration signal having a negative polarity from the differentiating circuit 134, which signal will be inverted to a signal A having a positive polarity. Thus, the absolute magnitude of the velocity signal will be increased by a car accelerating towards the bottom terminal in the bottom terminal protection zone. A car approaching the terminal at constant speed will not increase, or decrease the value of the absolute magnitude of the velocity signal, since in this instance the magnitude of the acceleration signal will be zero.

A car going down in the middle zone provides two logic ones at the two inputs of NAND gate 236, turning transistor 240 and JFET 242 on. This forces the inverting mode for amplifier 136, which mode is retained as the car enters the bottom terminal protection zone, just described.

A car traveling downwardly in the top terminal zone applies two logic one signals to the inputs of NAND gate 238, forcing the output of NAND gate 236 high to render PNP transistor 240 and JFET 242 non-conductive. Thus, amplifier 136 will be in its non-inverting mode. The negative acceleration signal provided by differentiator 134 as the car accelerates from the top terminal floor will thus reduce the magnitude of the absolute value of the velocity signal, as required.

As described in the incorporated application and illustrated in FIG. 2 of the incorporated application, speed checkpoints for monitoring terminal slowdown and initiating the switch to the auxiliary terminal slowdown pattern, or for initiating an emergency stop, are provided by a plurality of relays S1 through S(N), with N depending upon the contract speed of the elevator. FIG. 5 of the present application illustrates two such speed checkpoints provided by relays S1 and S2. These relays are part of control 129 shown in FIG. 1. A speed checkpoint may be provided for 350 feet per minute by relay S1 using a comparator 260, signal VT1B' from the tachometer 52, and a positive reference voltage RV1. If the scaling of scaler 152 in FIG. 1 is 10 volts for 1800 fpm, for example, a reference voltage having a magnitude of 350/1800 × 10, or 1.94 volts would be used. The next speed checkpoint, which is provided by relay S2 and a comparator 262 may utilize velocity signal VT2B', following the alternate use of the two tachometers disclosed in the incorporated application, and a positive reference signal RV2. Signal RV2 for a 440 fpm speed, for example, may have a magnitude of 440/1800 × 10, or 2.44 volts. The remaining speed checkpoints are illustrated generally at 264. In the example illustrated in Table II, six additional speed checkpoints would be utilized.

FIG. 6 is a schematic diagram which illustrates a portion of the supervisory control 129 shown in FIG. 1, which circuitry utilizes the speed checkpoint indications of FIG. 5 to initiate the transfer to the auxiliary terminal slowdown pattern provided by the terminal slowdown pattern generator 131 illustrated in FIG. 1, or to initiate an emergency stop. The normal slowdown pattern VSP is provided by speed pattern generator 50 illustrated in FIG. 1. FIG. 6 illustrates a portion of FIG. 4 of the incorporated application. The indication that the auxiliary terminal slowdown speed pattern provided by the TSD pattern generator 131 shown in FIG. 1 is required, is provided by a relay TSD. Relay TSD is energized through a string of closed switches or contacts which open one by one as the elevator car reaches pretermined points in the hoistway. These car position contacts are shunted by contacts of the speed indication relays shown in FIG. 5. If a speed relay drops before reaching the associated speed checkpoint in the hoistway, the associated contact of the speed relay closes to shunt the position switch, and when the latter opens at a predetermined car position in the hoistway, it has no circuit effect. If a speed relay is still energized when the elevator car reaches its associated check position in the hoistway, the circuit of relay TSD will be broken, relay TSD will drop and a contact of relay TSD initiates auxiliary terminal slowdown. Position switches or contacts associated with position switches are provided adjacent both the upper and lower terminals of the associated building, with switches or contacts DS1-1 and US1-1 indicating the first car position switches adjacent to the top and bottom terminals, respectively.

Contacts DS1-1 and US1-1 are connected in series, and this series branch is shunted by a normally closed contact S1-1 of speed relay S1. In like manner, the next car position checkpoint in the down and up directions is provided by serially connected contacts DS2-1 and US2-1, respectively, which are shunted by contact S2-1 of relay S2. This ladder-like circuit of contacts, including the remaining contacts of the position switches and contacts of the speed relays, connects relay TSD to a source of unidirectional potential indicated by conductors L1 and L2.

If the elevator car is exceeding a predetermined speed at a position checkpoint adjacent to a terminal, which predetermined speed is higher than the predetermined speed which initiates auxiliary terminal slowdown, an emergency stop is initiated. The indication that an emergency stop is required is provided by a relay 29 shown in FIG. 6. Relay 29 is normally continuously energized, dropping out only when an emergency stop is required.

The TSD relay and the 29 relay utilize the same speed relays, but each checks the condition of a different speed relay at each car position checkpoint. The first car position checkpoint for the 29 relay is one checkpoint closer to the terminal than the first checkpoint for the TSD relay, and it checks the condition of the speed relay previously checked at the immediately preceding checkpoint by the TSD relay. This pattern of checking the speed relays continues as the elevator car reaches the other speed checkpoints, with the 29 relay always using a higher numbered speed relay for comparison with a specific car location than that currently being used by the TSD relay. The contacts of the car position relays are connected in series with the usual safety circuits, and relay 29, between busses L1 and L2. For example, as illustrated in FIG. 6, contacts DS1-2 and US1-2 are shunted by contact S2-2 of the speed relay S2, etc. When the speed checkpoint DS1-2 or US1-2 is reached by the elevator car, the speed of the elevator car should be below the speed at which the speed relay S2 drops. If it is, contact S2-2 will already be closed when contact DS1-2 or contact US1-2 opens, and relay 29 will remain energized. If the car speed is above the value at which relay S2 drops out when the speed checkpoint DS1-2 or US1-2 is reached, relay 29 will be deenergized and a contact of relay 29 will initiate an emergency stop of the elevator car.

In the embodiment of the invention shown in FIGS. 1 and 4, a bias equal to $(K_5{}^2J/2)$ was developed which slightly reduced the full benefit of the acceleration term $K_5A$. This was necessary, as hereinbefore explained, in order to prevent nuisance tripping of the TSD relay during normal short runs towards a terminal floor, during which the elevator car would be accelerating towards a terminal floor in the terminal protection zone.

Figure 7:
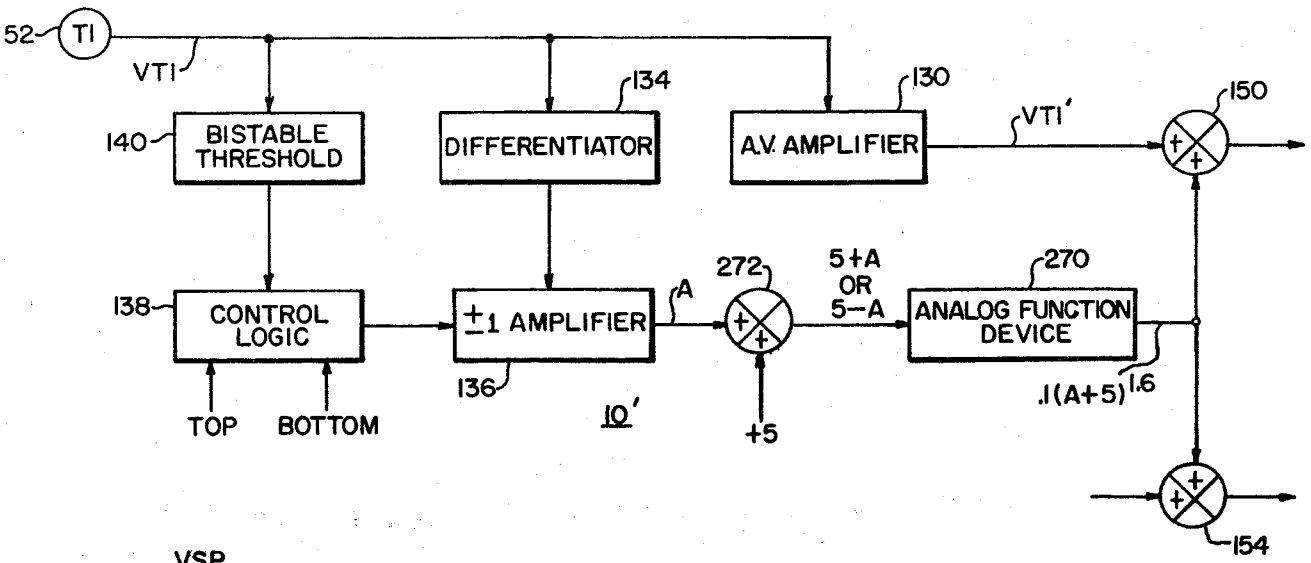
FIGS. 7 and 8 are block diagrams which illustrate modifications of the elevator system shown in FIG. 1, which modifications are in accordance with additional embodiments of the invention.

The $K_5{}^2J/2$ bias may be eliminated by generating a complex function of the acceleration signal A. FIG. 7 is a block diagram of an elevator system 10′ constructed according to an embodiment of the invention which incorporates a complex function generator. Elevator system 10′ is similar to elevator system 10 shown in FIG. 1, except the placement of each car position checkpoint for a given speed is slightly farther from the terminal floor, i.e., the $(K_5{}^2J/2)$ bias is eliminated, a complex function generator 270 has been added, and another summing circuit 272 has been added. Like functions in FIGS. 1 and 2 are identified with like reference numerals, and will not be described again in detail.

More specifically, the acceleration signal A appearing at the output of amplifier 136 is summed with a +5 volt unidirectional signal in summing circuit 272. Summing circuit 272 thus provides a signal 5+A, or 5−A, depending upon the polarity of the acceleration signal A.

The output signal 5±A is applied to an analog function device 270, such as Burr Brown's BB4302, which provides a signal $K_{1(A+R)}{}^B$. This device is programmed to provide a signal equal to $0.1(A+5)^{1.6}$, i.e., $K_1$ is equal to 0.1, R is equal to 5, and B is equal to 1.6. This signal is applied to the summing circuits 150 and 154, as hereinbefore described relative to FIG. 1.

The incorporated application utilizes a monitoring circuit which continuously checks to insure that the elevator car is following the speed pattern signal. This circuit processes the speed pattern signal to provide the expected response of the elevator car, and the expected response of the elevator car is compared with the actual response of the elevator car. The error between these two signals should always be very low, and thus the reference signal which is compared with this error signal may be a very small value. Thus, this monitoring circuit is completely different than one which monitors the error signal developed between the speed pattern and the actual response of the elevator car, which error signal is normally quite large during certain portions of the speed pattern signal due to system time delay.

When the monitor described in the incorporated application is used to insure that the elevator car is following the speed pattern, the speed pattern signal VSP may safely be used to provide the acceleration signal A which is used in the present invention to modify the velocity signal used in the speed checking circuits. Developing the acceleration signal A from the speed pattern VSP enables the signal to be filtered and delayed by about 0.25 seconds (i.e., a value depending upon the system time delay), so that the acceleration signal used to modify the velocity signal is well filtered and it represents the acceleration of the car with very little time delay.

Figure 8:
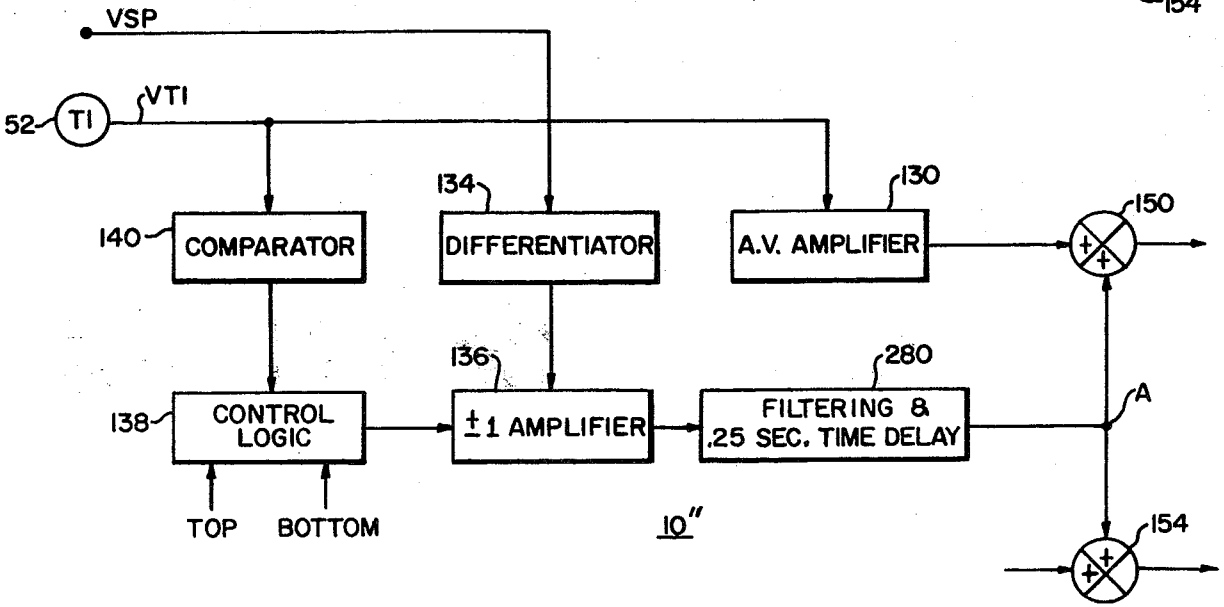

FIG. 8 is a block diagram of an elevator system 10″ constructed according to an embodiment of the invention which utilizes the speed pattern signal VSP to develop the acceleration signal A. Elevator system 10″ is similar to elevator system 10 shown in FIG. 1, except the differentiating circuit 134 is connected to receive the speed pattern signal VSP, instead of the tachometer signal VT1, and a filter and time delay circuit 280 has been added to process the output of amplifier 136. The acceleration signal A may then be applied directly to the summing circuits 150 and 154, as illustrated in FIG. 1, or it may be processed as described in FIG. 7, depending upon whether or not the $(K_5{}^2J/2)$ bias is used.

We claim as our invention:

1. An elevator system comprising:
an elevator car,
motive means for effecting movement of said elevator car in a predetermined travel path,
means providing a velocity signal related to the velocity of said elevator car,
means providing an acceleration signal related to the acceleration of said elevator car,
means modifying said velocity signal responsive to said acceleration signal,
and monitoring means responsive to the modified velocity signal for detecting a malfunction in the operation of said elevator car.

2. The elevator system of claim 1 wherein the means modifying the velocity signal decreases the absolute magnitude of the velocity signal by an amount related to the acceleration signal, when the car acceleration is negative and the elevator car is approaching either end of its travel path.

3. The elevator system of claim 1 wherein the means modifying the velocity signal decreases the absolute magnitude of the velocity signal by an amount related to the acceleration signal when the acceleration is negative and the elevator car is approaching either end of its travel path, and when the acceleration is positive and the elevator car is departing from either end of its travel path.

4. The elevator system of claim 1 including means modifying the acceleration signal, with the modified acceleration signal being used by the means which modifies the velocity signal.

5. The elevator system of claim 4 wherein the means which modifies the acceleration signal reduces the magnitude of the acceleration signal by a factor related to the rate of change of acceleration of the elevator car.

6. The elevator system of claim 4 wherein the means which modifies the acceleration signal includes means summing the acceleration signal $\pm A$ with a reference $+R$, and means processing the sum according to the complex function $K_{1(A+R)}^{B}$.

7. The elevator system of claim 1 wherein the means providing the acceleration signal includes means differentiating the velocity signal.

8. The elevator system of claim 1 including means providing a speed pattern signal for the motive means, and wherein the means providing the acceleration signal includes means differentiating the speed pattern signal.

9. The elevator system of claim 1 including car position means providing a car position signal at a predetermined point in the travel path of the elevator car, and wherein the monitoring means includes reference means and comparison means, said reference means providing a reference signal having a magnitude related to the maximum desired speed of the elevator car at said predetermined point in the travel path, and said comparison means comparing the modified velocity signal with said reference signal to detect when the elevator car exceeds the maximum desired speed at the predetermined point in the travel path.

10. The elevator system of claim 1 including car position means providing a plurality of car position signals, each at a different predetermined point in the travel path of the elevator car, as the elevator car reaches each point, and wherein the monitoring means includes reference means and comparison means, said reference means providing a plurality of reference signals, each of which has a magnitude related to the maximum desired speed of the elevator car at one of the predetermined points in the travel path, and said comparison means sequentially comparing the modified velocity signal with each of said reference signals as its associated car position signal is provided by said car position means, to detect when the elevator car exceeds the maximum desired speed at any of said predetermined points in the travel path.

* * * * *